US012570910B2

(12) United States Patent
Giri et al.

(10) Patent No.: US 12,570,910 B2
(45) Date of Patent: Mar. 10, 2026

(54) SYSTEMS AND METHODS FOR PROCESSING PYROLYSIS OIL

(71) Applicant: SABIC Global Technologies B.V., Bergen op Zoom (NL)

(72) Inventors: Anupam Giri, Bergen op Zoom (NL); Ahmad Reza Emamjomeh, Bergen op Zoom (NL); Fabrice Cuoq, Geleen (NL)

(73) Assignee: SABIC Global Technologies B.V., Bergen op Zoom (NL)

( * ) Notice: Subject to any disclaimer, the term of this patent is extended or adjusted under 35 U.S.C. 154(b) by 341 days.

(21) Appl. No.: 18/000,309

(22) PCT Filed: Jun. 10, 2021

(86) PCT No.: PCT/IB2021/055115
§ 371 (c)(1),
(2) Date: Nov. 30, 2022

(87) PCT Pub. No.: WO2021/255591
PCT Pub. Date: Dec. 23, 2021

(65) Prior Publication Data

US 2023/0203387 A1 Jun. 29, 2023

Related U.S. Application Data

(60) Provisional application No. 63/039,868, filed on Jun. 16, 2020.

(51) Int. Cl.
*C10G 55/04* (2006.01)
*C10G 25/05* (2006.01)

(52) U.S. Cl.
CPC ..... *C10G 55/04* (2013.01); *C10G 2300/1037* (2013.01); *C10G 2300/201* (2013.01);
(Continued)

(58) Field of Classification Search
CPC ..... C10G 55/04; C10G 2300/1037; C10G 2300/201; C10G 2300/4006;
(Continued)

(56) References Cited

U.S. PATENT DOCUMENTS 5,894,012 A 4/1999 Denison
2008/0035528 A1 2/2008 Marker
(Continued)

FOREIGN PATENT DOCUMENTS

CN 103589454 A 2/2014
CN 103937543 A 7/2014
(Continued)

OTHER PUBLICATIONS

Perez-Page et al. ("Gas adsorption properties of ZSM-5 zeolites heated to extreme temperatures." Ceramics International 42 (2016) 15423-15431) (Year: 2016).*
(Continued)

*Primary Examiner* — In Suk C Bullock
*Assistant Examiner* — Jason Y Chong
(74) *Attorney, Agent, or Firm* — Norton Rose Fulbright US LLP

(57) ABSTRACT

Systems and methods of processing pyoil are disclosed. A pyoil is treated by an adsorbent to trap, and/or adsorb gum and/or gum precursors and other heteroatom containing components, thereby removing the gum and/or gum precursors from the pyoil and producing a purified pyoil. The purified pyoil can then be cracked to produce chemicals including olefins and aromatics.

19 Claims, 10 Drawing Sheets

(52) U.S. Cl.
CPC ..... *C10G 2300/4006* (2013.01); *C10G 2300/4012* (2013.01); *C10G 2300/807* (2013.01); *C10G 2400/20* (2013.01); *C10G 2400/30* (2013.01)

(58) Field of Classification Search
CPC ..... C10G 2300/4012; C10G 2300/807; C10G 2400/20; C10G 2400/30; C10G 1/002; C10G 25/05; C10G 25/12
See application file for complete search history.

(56) References Cited

U.S. PATENT DOCUMENTS

| | | | | |
|---|---|---|---|---|
| 2009/0156876 | A1 | 6/2009 | Ou et al. | |
| 2019/0161683 | A1* | 5/2019 | Narayanaswamy ... | C10G 69/14 |
| 2019/0270939 | A1* | 9/2019 | Javeed ..... | C10G 1/002 |
| 2021/0189249 | A1* | 6/2021 | Timken ..... | C10G 51/023 |

FOREIGN PATENT DOCUMENTS

| | | | | |
|---|---|---|---|---|
| CN | 109749763 | A | 5/2019 | |
| CN | 111171865 | A | 5/2020 | |
| DE | 202015009755 | U1 | 2/2020 | |
| EP | 3907267 | A1 * | 11/2021 | ..... C01B 3/34 |
| IN | 201841018816 | A | 11/2019 | |
| JP | 2019-532118 | A | 11/2019 | |
| JP | 2023-503687 | A | 1/2023 | |
| JP | 2023-514696 | A | 4/2023 | |
| KR | 1020120088416 | A | 8/2012 | |
| WO | WO2021224287 | A1 | 11/2021 | |

OTHER PUBLICATIONS

Ackermann, L. "Gum Formation in Cracked Gasolines." Department of Chemical Technology, Technical University, Budapest, 1968, pp. 29-39.
Bao et al. "Study on biomass pyrolytic liquid products with MCM-41/SBA-15 as catalyst." Journal of Fuel Chemistry and Technology, vol. 34, No. 6, Dec. 2006, pp. 675-679. Abstract Only.
Benson et al. "Catalytic Deoxygenation Chemistry: Upgrading of Liquids Derived from Biomass Processing" Advances in Catalysis, vol. 56, 2013, pp. 187-353.
Brooks, Benjamin T. "The Chemistry of Gasolines: Particularly with Respect to Gum Formation and Discoloration." *Ind. Eng. Chem.* 1926, 18, 1198-1203.
Cabot infosheet. "Field Condensate and NGL Purification." CABOT Norit Activated Carbon, 2016, 4 pages.
Cassar, Harold A. "Gumming Tendencies of Pure Olefins in Gasoline." *Industrial and Engineering Chemistry*, vol. 23, No. 10, Jun. 1931, pp. 1132-1134.
De la Puente et al. "Formation of Gum Precursors in FCC Naphthas." *Energy & Fuels*, 2004, 18, 460-464.
Dryer et al. "Mechanism of Gum Formation in Cracked Gasoline." *Industrial and Engineering Chemistry*, vol. 26, No. 8, Aug. 1934, pp. 885-888.
Flood et al. "Chemical Nature of Gum-Forming Constituents in Gasoline." *Industrial and Engineering Chemistry*, vol. 25, No. 11, Nov. 1933, pp. 1234-1239.
International Search Report and Written Opinion from PCT/IB2021/055115 dated Sep. 17, 2021, 10 pages.
Kim et al. "Tar-formation kinetics and adsorption characteristics of pyrolyzed waste lubricating oil." *Journal of Analytical and Applied Physics*, vol. 70, No. 1, Oct. 2003, pp. 19-33.
Martin, Jr. et al. "Distribution of Gum-Forming Constituents in Cracked Gasoline." *Industrial and Engineering Chemistry*, vol. 25, No. 4, Apr. 1933, pp. 381-386.
Mayo et al. "Gum and deposit formation from jet turbine and diesel fuels at 130° C." *Ind. Eng. Chem. Prod. Res. Dev.* 1986, 25, 333-348.
Morrell et al. "Gum in Cracked Gasoline . . . Formation and Composition." *Industrial and Engineering Chemistry*, vol. 28, No. 4, Apr. 1936, pp. 465-469.
Pradelle et al. "Gum Formation in Gasoline and Its Blends: a Review." *Energy Fuels*, 2015, 29(12), 7753-7770.
Rogers et al. "Gum Formation in Gasoline I. Measurement of Gum Stability of Gasoline." *Industrial and Engineering Chemistry*, vol. 25, No. 4, Apr. 1933, pp. 397-402.
Rogers et al. "Gum Formation in Gasoline II. Control of Gum Formation in Gasoline by Antioxidants." *Industrial and Engineering Chemistry*, vol. 25, No. 5, May 1933, pp. 520-523.
Story et al. "Chemistry of Gum Formation by Cracked Gasoline." *Industrial and Engineering Chemistry*, vol. 21, No. 11, Nov. 1929, pp. 1079-1084.
Walters et al. "Chemistry of Gum Formation in Cracked Gasoline." *Industrial and Engineering Chemistry*, vol. 41, No. 8, Aug. 1949, pp. 1723-1729.
Yule et al. "Peroxides and Gum in Gasoline." *Industrial and Engineering Chemistry*, vol. 23, No. 11, Nov. 1931, pp. 1254-1259.
Bao et al. "Study on biomass pyrolytic liquid products with MCM-41/SBA-15 as catalyst." Journal of Fuel Chemistry and Technology, vol. 34, No. 6, Dec. 2006, pp. 675-679. English Machine Translation.

* cited by examiner

SYSTEMS AND METHODS FOR PROCESSING PYROLYSIS OIL

CROSS REFERENCE TO RELATED APPLICATIONS

This application is a national phase application under 35 U.S.C. § 371 of International Application No. PCT/IB2021/055115 filed Jun. 10, 2021, which claims priority to U.S. Provisional Patent Application No. 63/039,868 filed Jun. 16, 2020. The entire contents of each of the above-referenced disclosures is specifically incorporated by reference herein without disclaimer.

FIELD OF INVENTION

The present invention generally relates to systems and methods of processing pyrolysis oil (pyoil). More specifically, the present invention relates to system and methods for pre-treating pyoil to create a more stable pyoil product and/or a more desirable pyoil raw material for cracking.

BACKGROUND OF THE INVENTION

Plastics are ubiquitous in industrial and domestic applications. While tons of plastics are produced every day, waste plastics have created serious environmental challenges due to their extremely long natural decomposition process. Thus, various processes for reuse and/or recycle plastics have been explored in the last few decades.

Pyrolysis of mixed plastics is a process that includes decomposing plastics at a high temperature to produce a pyoil. Pyoil can be used directly as a liquid fuel or further processed for producing chemicals of high value. However, pyoil produced from mixed plastics generally contains a substantial amount of highly reactive chemicals, resulting in fast aging of the pyoil and formation of gums during transportation and further processing steps. Hence, it is fairly common for pyoil to foul containers and/or chemical processing units in which it is handled and/or processed with trace oxygen presented therein.

In the context of the present invention, at least twenty embodiments are now described. Embodiment 1 is a method of processing pyrolysis oil (pyoil). The method includes the steps of treating the pyoil with an adsorbent and thereby removing gum and/or gum precursors from the pyoil to produce a purified pyoil; and cracking the purified pyoil under reaction conditions sufficient to produce olefins and aromatics. Embodiment 2 is the method of embodiment 1, wherein the treating step is further configured to increase stability of the pyoil. Embodiment 3 is the method of any of embodiments 1 and 2, wherein the treating step includes flowing the pyoil through an adsorbent under processing conditions sufficient to remove at least some of, one or more of: (a) oxygen containing compounds, (b) nitrogen containing compounds, (c) chlorine containing compounds, (d) polynuclear aromatics and heavy tails (C20+), (e) silicon containing compounds, and (f) heavy metals from the pyoil. Embodiment 4 is the method of embodiment 3, wherein the adsorbent is contained in a guard bed, a purification column, a stirring tank, a fluidized bed, or a combination thereof. Embodiment 5 is the method of any of embodiments 3 and 4, wherein the adsorbent contains an activated charcoal (carbon), a molecular sieve, a bleaching clay, a silica hydrogel, an ionic resin, a cured eggshell powder, or combinations thereof. Embodiment 6 is the method of embodiment 5, wherein the molecular sieve is configured to lighten the color of the pyoil, reduce total organic nitrogen, reduce density of the pyoil, reduce chlorinates concentration in the pyoil, reduce oxygenates of the pyoil, minimize the corrosion and/or fouling on downstream equipment, or combinations thereof. Embodiment 7 is the method of any of embodiments 5 and 6, wherein the molecular sieve contains $K_{12}[(AlO_2)_{12}(SiO_2)_{12}]\cdot nH_2O$, $Na_{12}[(AlO_2)_{12}(SiO_2)_{12}]\sim nH_2O$, $Ca_{4.5}[(AlO_2)_{12}(SiO_2)_{12}]\cdot nH_2O$, $Na_{86}[(AlO_2)_{86}(SiO_2)_{106}]\cdot nH_2O$, or combinations thereof. Embodiment 8 is the method of any of embodiments 5 to 7, wherein the molecular sieve has a pore size of 3 to 10 Å. Embodiment 9 is the method of any of embodiments 5 to 8, wherein the adsorbent has a surface area in a range of 10 to 8000 $m^2/g$. Embodiment 10 is the method of any of embodiments 3 to 9, wherein the oxygen and/or nitrogen containing compounds include aliphatic acids, aromatic acids, nitriles, amines, aldehydes, aliphatic/cyclic ketones, cyclic amides, aliphatic/aromatic alcohols, diols, esters, ethers, aliphatic/cyclic chlorines, furans, indoles, quinolines, phenolic compound, indolic compounds, acidic compounds, alcohols, amines, or combinations thereof. Embodiment 11 is the method of embodiment 10, wherein the oxygen and/or nitrogen containing compounds include 2-heptadecanone, 2-pentanone, caprolactam, 3-heptanol, methyl (iso2), octadecanenitrile, oleanitrile, cyclopentanone, traidecanenitrile, heptanoic acid, doedecanophenone, 2-cyclopentenol, 1-butanol, benzoic acid, hexanenitrile, tridecanenitrile, 2-cyclopenten-1-one, 2-hydroxy-3-m, phenol, C5 substituted (iso2), 2-cyclopenten-1-one, 3-ethyl-2-hydro, or combinations thereof. Embodiment 12 is the method of any of embodiments 1 to 11, wherein the process conditions in the treating step include a processing temperature of 10 to 100° C. Embodiment 13 is the method of any of embodiments 1 to 12, wherein the process conditions in the treating step include a processing pressure of 0.1 to 10 bar. Embodiment 14 is the method of any of embodiments 1 to 13, wherein the adsorbent has substantially no or no impact on hydrocarbon cracking value of the pyoil. Embodiment 15 is the method of any of embodiments 1 to 14, wherein the cracking includes steam-cracking. Embodiment 16 is the method of embodiment 15, wherein the steam cracking is conducted at a cracking temperature of 750 to 900° C. Embodiment 17 is the method of any of embodiments 15 and 16, wherein the steam cracking is conducted at a residence time of 1 to 4000 ms. Embodiment 18 is the method of any of embodiments 1 to 17, further including the step of regenerating the adsorbent via thermal regeneration, thermal and vacuum regeneration, rinsing with strong acid or strong basic solutions, solvent rinsing of the adsorbent, or combinations thereof. Embodiment 19 is the method of any of embodiments 1 to 18, further including removing the adsorbent from the purified pyoil via settling, filtration, cyclone, or combinations thereof.

Embodiment 20 is a method of processing pyoil. The method includes the steps of treating the pyoil with one or more non-silica based adsorbents and thereby removing gum and/or gum precursors from the pyoil to produce a purified pyoil; and utilizing the purified pyoil as a liquid fuel.

Overall, while systems and methods for processing or storing pyoil derived from mixed plastics exist, the need for improvements in this field persists in light of at least the aforementioned drawbacks of conventional systems and methods.

BRIEF SUMMARY OF THE INVENTION

A solution to at least some of the above-mentioned problems associated with the systems and methods of processing pyoil derived from plastics has been discovered. The solution resides in a method of processing pyoil comprising treating the pyrolysis oil with an adsorbent to (1) remove gum and/or gum precursors from the pyoil and/or (2) increase stability of the pyoil, thereby reducing fouling and corrosivity of purified pyoil. Furthermore, the purified pyoil after the treating step can be cracked to produce high value products including olefins and aromatics (e.g., BTX), increasing the value of the pyoil. Additionally, the pyoil can be obtained from mixed plastics, thereby reducing the pollution caused by plastics. The adsorbent can include materials with high surface areas (e.g., molecular sieves and activated charcoal) or specific active targets that target acidic or basic contaminants (e.g., ion exchange resin), which can significantly increase the adsorption efficiency for removing gum precursors and/or oxidants. Therefore, the disclosed methods provide a technical achievement over the conventional method for processing pyoil.

Embodiments of the invention include a method of processing pyoil. The method comprises treating the pyoil with an adsorbent and thereby removing gum and/or gum precursors from the pyoil to produce a purified pyoil. The method comprises cracking the purified pyoil under reaction conditions sufficient to produce olefins and aromatics.

Embodiments of the invention include a method of processing pyoil. The method comprises flowing the pyoil through an adsorbent under processing conditions sufficient to remove at least some of, one or more of: (a) oxygen containing compounds, (b) nitrogen containing compounds, (c) chlorine containing compounds, (d) polynuclear aromatics and heavy tails ($C_{20}$+), (e) silicon containing compounds, and (f) heavy metals from the pyoil, and produce a purified pyoil. The method comprises cracking the purified pyoil under reaction conditions sufficient to produce olefins and aromatics.

Embodiments of the invention include a method of processing pyoil. The method comprises flowing the pyoil through a guard bed, a purification column, a fluidized bed, and/or a stirring tank comprising an adsorbent under processing conditions sufficient to remove at least some of, one or more of: (a) oxygen containing compounds, (b) nitrogen containing compounds, (c) chlorine containing compounds, (d) polynuclear aromatics and heavy tails ($C_{20}$+), (e) silicon containing compounds, and (f) heavy metals from the pyoil, and produce a purified pyoil. The method comprises steam-cracking the purified pyoil under reaction conditions sufficient to produce olefins and aromatics.

Embodiments of the invention include a method of processing pyoil. The method comprises treating the pyoil with one or more non-silica based adsorbents and thereby removing gum and/or gum precursors from the pyoil to produce a purified pyoil. The method comprises using the purified pyoil as a liquid fuel.

The following includes definitions of various terms and phrases used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refer to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, include any measurable decrease or complete inhibition to achieve a desired result.

The term "effective," as that term is used in the specification and/or claims, means adequate to accomplish a desired, expected, or intended result.

The term "gum," as that term is used in the specification and/or claims, means phased out solid and/or creamy and/or semisolids portion from liquid pyoil. In embodiments of the invention, "gum" can include components having an average molecular weight of 400 Dalton that are soluble or crash out of the solution and/or liquid. Many cracked gasolines, especially those unrefined, a thick resinous material deposited under certain conditions can include gum. For instance, on long standing in dark condition or diffused light condition, it is common that a semi-fluid material, known as "gum", gradually accumulate as a brown, sticky mass at the bottom of the oil. Another example of "gum" can include that a dark brown, hard, and resinous residue that can be obtained by evaporation of a liquid product including a cracked gasoline and/or pyoil in a copper dish.

The term "stability," as that term is used in the specification and/or claims, means pyoil composition is not altered over time by chemical reactions. In embodiments of the invention, "stability" can mean that there is limited or no reactivity of pyoil (treated by an adsorbent) due to cleaning/trapping of reactive substances by the adsorbent. As a result, substantially no or no further formation of gum or any other color changes occurred and properties remained unchanged for a longer period of time after purification.]

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

The term "primarily," as that term is used in the specification and/or claims, means greater than any of 50 wt. %, 50 mol. %, and 50 vol. %. For example, "primarily" may include 50.1 wt. % to 100 wt. % and all values and ranges there between, 50.1 mol. % to 100 mol. % and all values and ranges there between, or 50.1 vol. % to 100 vol. % and all values and ranges there between.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

For a more complete understanding, reference is now made to the following descriptions taken in conjunction with the accompanying drawings, in which:

(FIG. 4A shows upright vials, FIG. 4B shows bottom up vials);

(FIG. 4C shows upright vials, FIG. 4D shows bottom up vials);

DETAILED DESCRIPTION OF THE INVENTION

Currently, pyoil, especially pyoil derived from pyrolysis of plastics, has a high gum or gum precursor content, resulting in high gum formation, low stability, and high acidity of the pyoil. Thus, it is highly challenging to store, transport, and/or process pyoil in a chemical plant, resulting in pyoil often being directly burned as a fuel. The present invention provides a solution to at least some of these problems. The solution is premised on a method of processing pyoil. The method includes first treating the pyoil with an adsorbent to remove gum and/or gum precursors from the pyoil, thereby reducing the corrosivity and fouling risk of pyoil. Furthermore, by removing gum precursors, the stability of the pyoil can be greatly improved for storage, transportation, and further processing. Moreover, the purified pyoil produced by the treating step can be used in a cracking process to produce high value chemicals such as olefins, including light olefins ($C_2$ to $C_4$ olefins), $C_5$ olefins, and BTX (benzene, toluene, and xylene). These and other non-limiting aspects of the present invention are discussed in further detail in the following sections.

A. System for Processing Pyoil

Figure 1:
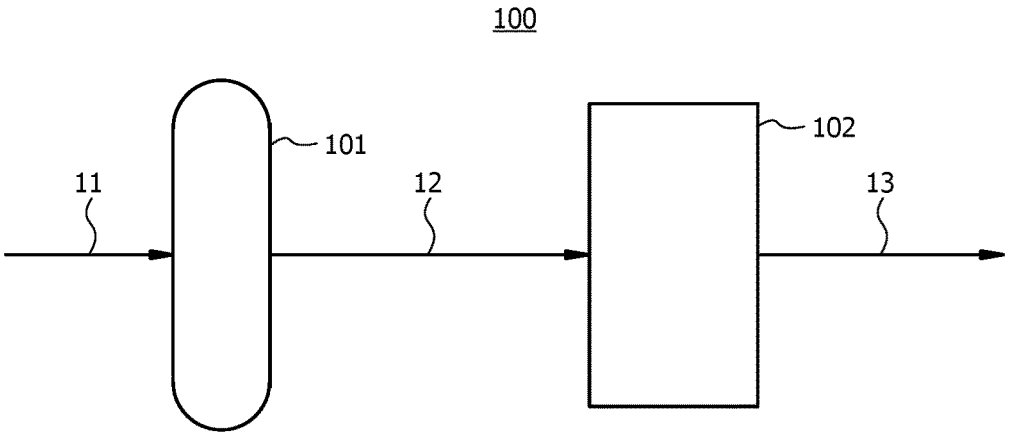
FIG. 1 shows a schematic diagram of a system for processing pyoil, according to embodiments of the invention.

In embodiments of the invention, the disclosed system can include a purification unit and a cracking unit. According to embodiments of the invention, the system is configured to facilitate production of high value chemicals from pyoil with reduced fouling and corrosion of cracking unit. With reference to FIG. 1, a schematic diagram is shown of system 100 for processing pyoil.

According to embodiments of the invention, system 100 includes purification unit 101 configured to (1) remove gum and/or gum precursors from pyoil of pyoil stream 11 and/or (2) increase stability of the pyoil to produce purified pyoil stream 12 comprising a purified pyoil. Pyoil stream 11 can include pyoil derived by pyrolysis of mixed plastics. In embodiments of the invention, purification unit 101 can include an adsorbent. The adsorbent comprises materials of surface areas configured to trap, adsorb, and/or remove at least some of, one or more of: (a) oxygen containing compounds, (b) nitrogen containing compounds, (c) chlorine containing compounds, (d) polynuclear aromatics and heavy tails ($C_{20}$+), (e) silicon containing compounds, and (f) heavy metals from the pyoil of pyoil stream 11, thereby removing gum and/or gum precursors from the pyoil and increasing stability of the pyoil. In embodiments of the invention, the adsorbent is configured to further remove other heteroatom containing compounds that are not gum or gum precursors. The adsorbent, in embodiments of the invention, is configured to further remove other oxygen containing compounds, nitrogen containing compounds, chlorine containing compounds that are not gum or gum precursors.

In embodiments of the invention, the oxygen and/or nitrogen containing compounds can include aliphatic acids, aromatic acids, nitriles, amines, aldehydes, aliphatic/cyclic ketones, cyclic amides, aliphatic/aromatic alcohols, diols, esters, ethers, aliphatic/cyclic chlorines, furans, indoles, quinolines, phenolic compound, indolic compounds, acidic compounds, alcohols, amines, or combinations thereof. The oxygen and/or nitrogen containing compounds can include 2-heptadecanone, 2-pentanone, caprolactam, 3-heptanol, methyl (iso2), octadecanenitrile, oleanitrile, cyclopentanone, traidecanenitrile, heptanoic acid, doedecanophenone, 2-cyclopentenol, 1-butanol, benzoic acid, hexanenitrile, tridecanenitrile, 2-cyclopenten-1-one, 2-hydroxy-3-methyl-, phenol, $C_5$ substituted (iso2), 2-cyclopenten-1-one, 3-ethyl-2-hydroxy-, or combinations thereof.

In embodiments of the invention, exemplary adsorbents of purification unit 101 can include an activated charcoal (carbon), a molecular sieve, a bleaching clay, a silica hydrogel, an ionic resin, a cured eggshell powder, and combinations thereof. Purification unit 101 can include a combination adsorbents, where the types of adsorbents are selected based on the species and concentration of compounds to be removed from the pyoil. The adsorbent can have a surface area in a range of 10 to 8000 $m^2/g$ and all ranges and values there between including ranges of 10 to 50 $m^2/g$, 50 to 100 $m^2/g$, 100 to 400 $m^2/g$, 400 to 700 $m^2/g$, 700 to 1000 $m^2/g$, 1000 to 2000 $m^2/g$, 2000 to 4000 $m^2/g$, 4000 to 6000 $m^2/g$, and 6000 to 8000 $m^2/g$. According to embodiments of the invention, the adsorbent of purification 101 comprises a molecular sieve and the molecular sieve is configured to lighten the color of the pyoil, reduce total organic nitrogen of the pyoil, reduce density of the pyoil, reduce chlorinates concentration in the pyoil, reduce oxygenates of the pyoil, minimize the corrosion and/or fouling on downstream equipment, or combinations thereof. In embodiments of the invention, the molecular sieve includes $K_{12}[(AlO_2)_{12}(SiO_2)_{12}]\cdot nH_2O$, $Na_{12}[(AlO_2)_{12}(SiO_2)_{12}]\cdot nH_2O$, $Ca_{4.5}[(AlO_2)_{12}(SiO_2)_{12}]\cdot nH_2O$, $Na_{86}[(AlO_2)_{86}(SiO_2)_{106}]\cdot nH_2O$, or combinations thereof. The molecular sieve can have a pore size of 3 to 10 Å and all ranges and values there between including ranges of 3 to 4 Å, 4 to 5 Å, 5 to 6 Å, 6 to 7 Å, 7 to 8 Å, 8 to 9 Å, and 9 to 10 Å. The molecular sieve can be in a form of granules, flakes, beads, powder, or combinations thereof.

In embodiments of the invention, the adsorbent includes an activated charcoal (carbon). The activated charcoal may have a pore size in a range of 1 to 100 Å. The activated charcoal may have a surface area of 10 to 8000 $m^2/g$. In embodiments of the invention, purification unit 101 can include a guard bed, a purification column, a fluidized bed, a stirring tank, or a combinations thereof. The adsorbent in purification unit 101 may form a fixed bed and/or a fluidized bed, or be dispersed in a stirring tank.

According to embodiments of the invention, an outlet of purification unit 101 is in fluid communication with cracking unit 102 such that purified pyoil stream 12 flows from purification unit 101 to cracking unit 102. In embodiments of the invention, cracking unit 102 may be configured to crack the purified pyoil of purified pyoil stream 12 to produce product stream 13 comprising olefins and aromatics. In embodiments of the invention, cracking unit 102 can include a steam cracker, a hydrocracker, and/or a fluid catalytic cracker. In embodiments of the invention, cracking unit 102 can include a hydrotreater installed upstream to the a steam cracker, a hydrocracker, and/or a fluid catalytic cracker configured to hydrotreat the purified pyoil before it is flowed in the a steam cracker, a hydrocracker, and/or a fluid catalytic cracker. Product stream 13 may include light olefins and BTX (benzene, toluene, and xylene).

In embodiments of the invention, purification unit 101 includes an adsorbent that is in powder form and system 100 can include a separation unit installed between purification unit 101 and cracking unit 102. The separation unit can be configured to separate the adsorbent from purified pyoil stream 12 before purified pyoil stream 12 is flowed into cracking unit 102. In embodiments of the invention, the separation unit can include a settling unit, a membrane, a filtration unit, a cyclone unit, or combinations thereof.

According to embodiments of the invention, system 100 can include an adsorbent regeneration unit configured to regenerate adsorbent (saturated or partially saturated) from purification unit 101 to remove the gum and/or gum precursors and produce regenerated adsorbent. As an alternative or in addition to an adsorbent regeneration unit, the absorbent (saturated or partially saturated) can be regenerated in purification unit 101 when purification unit 101 is not used for treating pyoil stream 11. In embodiments of the invention, at least a portion of saturated or partially saturated adsorbent of purification unit 101 can be discarded without regeneration.

B. Method of Processing Pyoil

Figure 2:
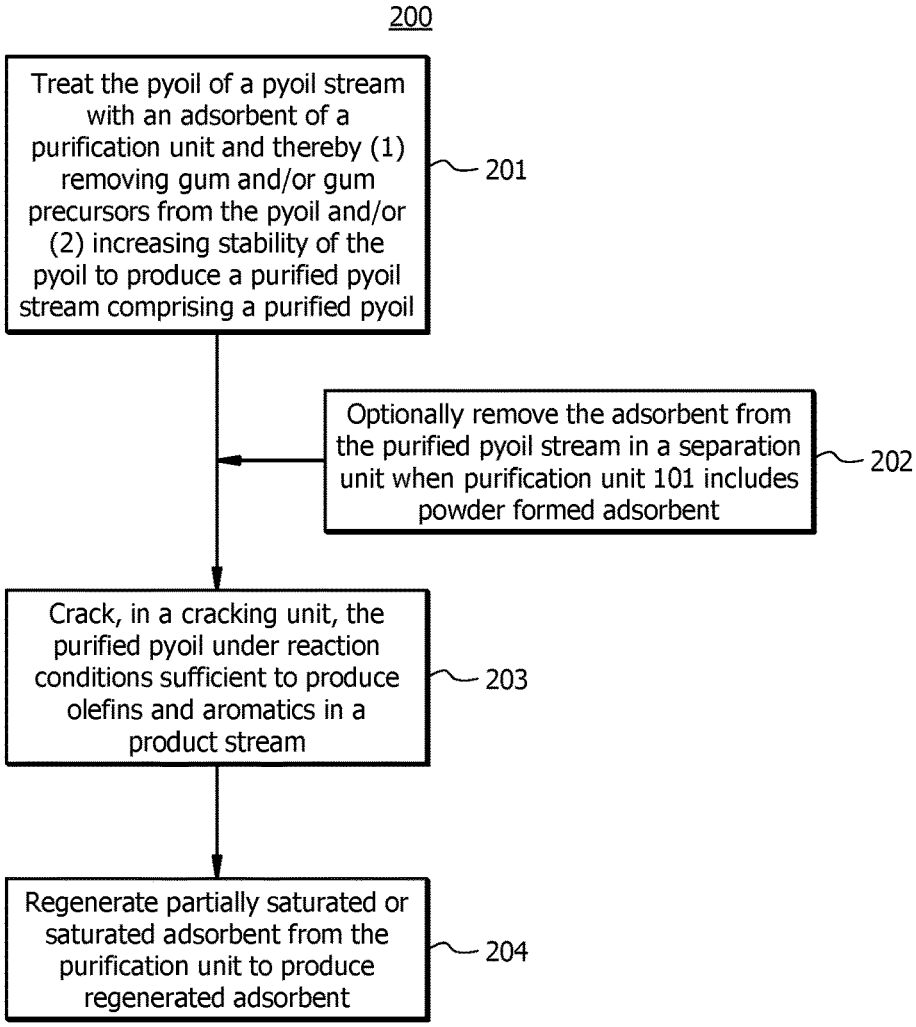
FIG. 2 shows a schematic flowchart for a method of processing pyoil, according to embodiments of the invention.

A method of processing pyoil has been discovered. The method can reduce fouling and/or corrosion during storage and/or chemical production process caused by pyoil compared to conventional methods. As shown in FIG. 2, embodiments of the invention include method 200 for processing pyoil. Method 200 may be implemented by system 100, as shown in FIG. 1 and described above. According to embodiments of the invention, as shown in block 201, method 200 includes treating the pyoil of pyoil stream 11 with the adsorbent of purification unit 101 and thereby removing gum and/or gum precursors from the pyoil and/or increasing stability of the pyoil to produce purified pyoil stream 12 comprising a purified pyoil. In embodiments of the invention, treating at block 201 is configured to further remove other heteroatom containing compounds that are not gum or gum precursors. Treating at block 201, in embodiments of the invention, is configured to further remove other oxygen containing compounds, nitrogen containing compounds, chlorine containing compounds that are not gum or gum precursors. In embodiments of the invention the pyoil includes pyoil derived from pyrolysis of mixed plastics and the pyoil has a boiling point range of 100 to 600° C. The pyoil derived from pyrolysis of mixed plastics can have a boiling curve range of 20 to 600° C.

In embodiments of the invention, treating at block 201 can include treating the pyoil by flowing it through the adsorbent of purification unit 101 under processing conditions sufficient to remove at least some of, one or more of: (a) oxygen containing compounds, (b) nitrogen containing compounds, (c) chlorine containing compounds, (d) polynuclear aromatics and heavy tails ($C_{20}$+), (e) silicon containing compounds (e.g., siloxanes), and (f) heavy metals from the pyoil. In embodiments of the invention, the adsorbent is configured to trap, adsorb, and/or adsorb the (a) oxygen containing compounds, (b) nitrogen containing compounds, (c) chlorine containing compounds, (d) polynuclear aromatics and heavy tails ($C_{20}$+), (e) silicon containing compounds, and (f) heavy metals. In embodiments of the invention, the processing conditions for the treating step at block 201 include a temperature of 10 to 100° C. and all ranges and values there between including ranges of 10 to 20° C., 20 to 30° C., 30 to 40° C., 40 to 50° C., 50 to 60° C., 60 to 70° C., 70 to 80° C., 80 to 90° C., and 90 to 100° C. The processing conditions for the treating step at block 201 can further include a pressure of 0.1 to 10 bar. In embodiments of the invention, adsorbents of purification unit 101 can include an activated charcoal (carbon), a molecular sieve, a bleaching clay, a silica hydrogel, an ionic resin, a cured eggshell powder, and combinations thereof. Purification unit 101 can include a combination adsorbents, where the types of adsorbents are selected based on the species and concentration of compounds to be removed from the pyoil. In embodiments of the invention, the adsorbent of purification unit 101 is configured in a fixed bed and the processing conditions for the treating step at block 201 can further include a weight hourly space velocity of 0.1 to 10 $hr^{-1}$ and all ranges and values there between including ranges of 0.1 to 0.5 $hr^{-1}$, 0.5 to 1 $hr^{-1}$, 1 to 2 $hr^{-1}$, 2 to 4 $hr^{-1}$, 4 to 6 $hr^{-1}$, 6 to 8 $hr^{-1}$, and 8 to 10 $hr^{-1}$. In embodiments of the invention, the adsorbent of purification unit 101 is dispersed in a stirring tank and the processing conditions for the treating step at block 201 can further include a mixing time of 1 minute to 10 hours and all ranges and values there between including 1 to 10 minutes, 10 to 30 minutes, 30 minutes to 1 hour, 1 to 2 hour, 2 to 3 hour, 3 to 4 hour, 4 to 5 hour, 5 to 6 hour, 6 to 7 hour, 7 to 8 hour, 8 to 9 hour, and 9 to 10 hour. In embodiments of the invention, pyoil produced by pyrolysis of plastics may be directly flowed through the adsorbent without other pretreatment (e.g., alkali rinsing, etc.). In embodiments of the invention, the adsorbent of purification unit 101 used at block 201 may not contain any added chemicals.

In embodiments of the invention, the treating at block 201 is further configured to reduce dark color of the pyoil, reduce total organic nitrogen, reduce density of the pyoil, reduce chlorinates concentration in the pyoil, reduce oxygenates of the pyoil, minimize the corrosion and/or fouling on downstream equipment, or combinations thereof.

In embodiments of the invention, purified pyoil stream 12 includes 0.01 to 2.5 wt. % oxygen containing compounds, 0.01 to 0.1 wt. % nitrogen containing compounds, 0.0001 to 0.01 wt. % chlorine containing compounds, 0.5 to 10 wt. % polynuclear aromatics and heavy tails ($C_{20}$+), 0.0001 to 0.01 wt. % silicon containing compounds, and/or 0.0001 to 0.01 wt. % heavy metals.

According to embodiments of the invention, as shown in block 202, method 200 includes optionally removing the adsorbent from purified pyoil stream 12 in a separation unit when purification unit 101 includes powder formed adsorbent. In embodiments of the invention, the removing at block 202 includes settling the adsorbent from purified pyoil stream 12, filtering purified pyoil stream 12, and/or processing purified pyoil stream 12 in a cyclone unit and/or a membrane unit.

According to embodiments of the invention, as shown in block 203, method 200 includes cracking, in cracking unit 102, the purified pyoil of purified pyoil stream 12 under reaction conditions sufficient to produce olefins and aromatics in product stream 13. In embodiments of the invention, the reaction conditions at block 203 include reaction temperature of 750 to 900° C. and a residence time of 1 to 4000 ms. In embodiments of the invention, the cracking at block 203 includes a steam cracking process, a fluid catalytic cracking process, a hydrocracking process, and/or a hydrotreating process. In embodiments of the invention, product stream 13 comprises 10 to 50 wt. % olefins.

According to embodiments of the invention, as shown in block 204, method 200 includes regenerating partially saturated or saturated adsorbent from purification unit 101 to produce regenerated adsorbent. In embodiments of the invention, the regenerating at block 204 can include burning the saturated or saturated adsorbent (thermal regeneration), vacuum and thermal regeneration, rinsing with strong acid or strong basic solution, and/or rinsing with polar organic solvent (e.g., tetrahydrofuran (THF)). In embodiments of the invention, at least some of the saturated or saturated adsorbent can be discarded without regeneration.

Although embodiments of the present invention have been described with reference to blocks of FIG. 2, it should be appreciated that operation of the present invention is not limited to the particular blocks and/or the particular order of the blocks illustrated in FIG. 2. Accordingly, embodiments of the invention may provide functionality as described herein using various blocks in a sequence different than that of FIG. 2.

The systems and processes described herein can also include various equipment that is not shown and is known to one of skill in the art of chemical processing. For example, some controllers, piping, computers, valves, pumps, heaters, thermocouples, pressure indicators, mixers, heat exchangers, and the like may not be shown.

As part of the disclosure of the present invention, specific examples are included below. The examples are for illustrative purposes only and are not intended to limit the invention. Those of ordinary skill in the art will readily recognize parameters that can be changed or modified to yield essentially the same results.

Example 1

Treating Pyoil with an Adsorbent

About 0.1 to 2 g of various adsorbent materials including molecular sieves and active charcoals etc., were added to the 10 mL of pyoil in 20 mL vials. The mixture was kept for a few days and gum deposits were observed.

Figure 3A:
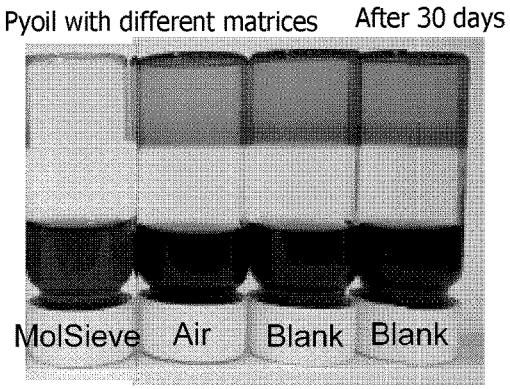
FIG. 3A shows photos of pyoil treated with different materials and/or processes (from left to right: molecular sieve, air purge, blank, and blank)
Figure 3B:
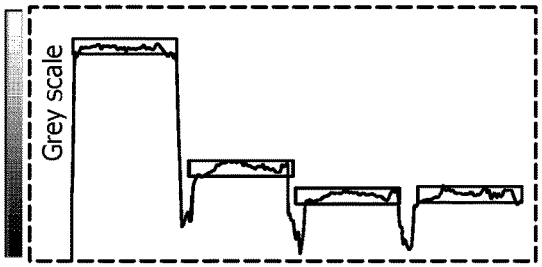
FIG. 3B shows grayscale analysis of gum formations in pyoil samples corresponding to the samples of FIG. 3A.

A molecular sieve and air purging (He, $N_2$, Air) were employed to treat pyoil, which was then compared to the untreated control. Results shown in FIG. 3A (visual) and FIG. 3B (grayscale value corresponding to each of the vials in FIG. 3A) clearly reveal that molecular sieve is capable of preventing the gum formation. Quantitative grey scale value of gum formation (FIG. 3B) indicates that purging pyoil for a minute with air has no significant impact on the gum formation.

Figure 3C:
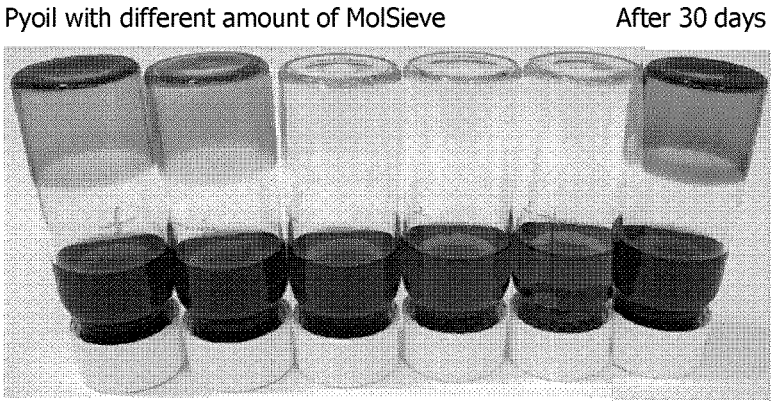
FIG. 3C shows formation of gum under different amount of molecular sieves.
Figure 3D:
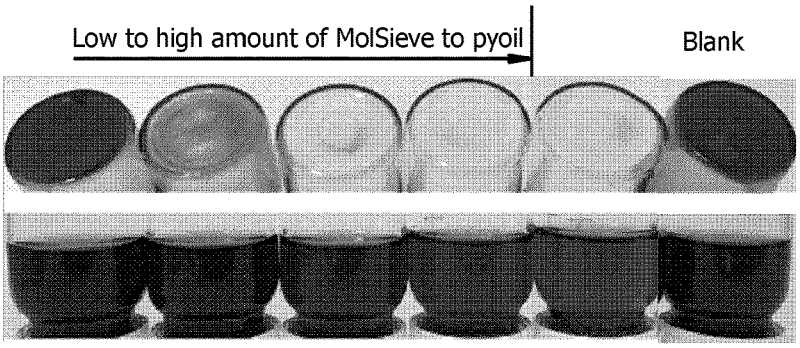
FIG. 3D shows deposition of gum at the bottom and colors of the treated pyoil for each sample of FIG. 3C.
Figure 4A:
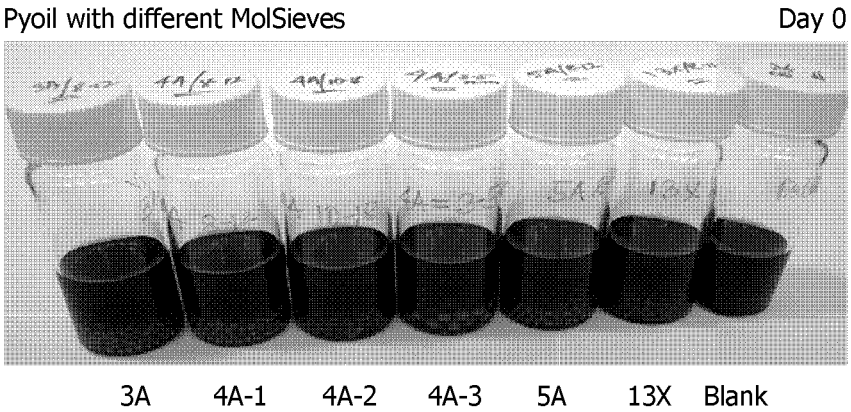
FIGS. 4A and 4B show photos of gum formation in pyoil with different types of molecular sieves at day 0
Figure 4B:
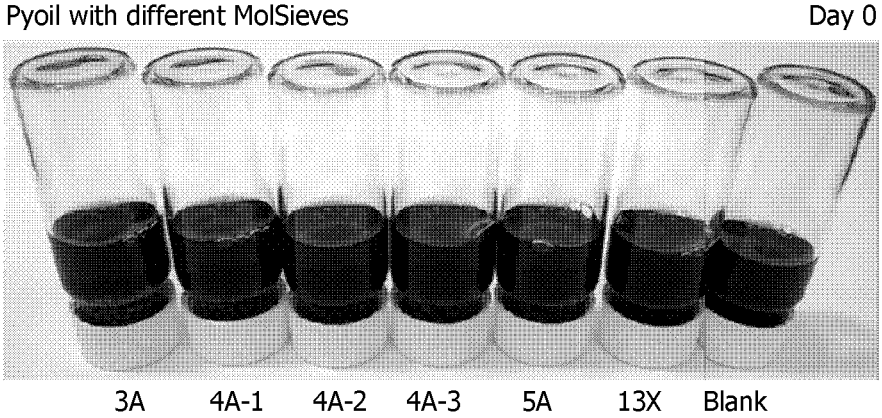
Figure 4C:
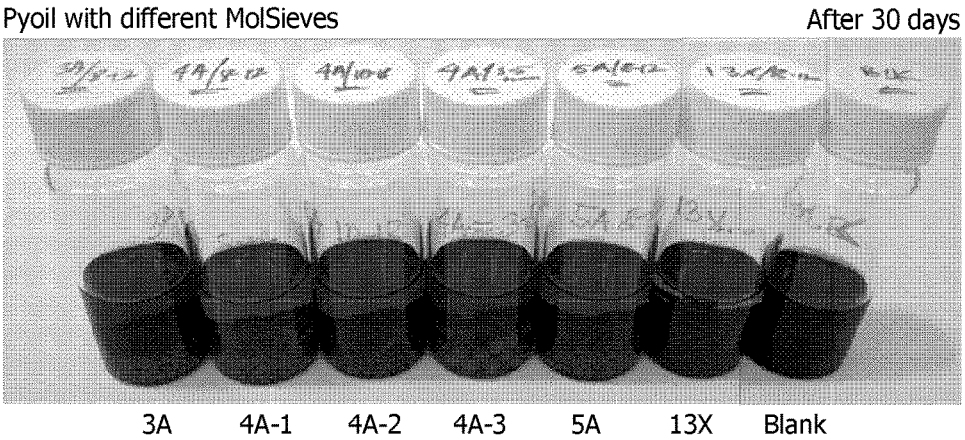
FIGS. 4C and 4D show photos of gum formation in pyoil with different types of molecular sieves at day 30
Figure 4D:
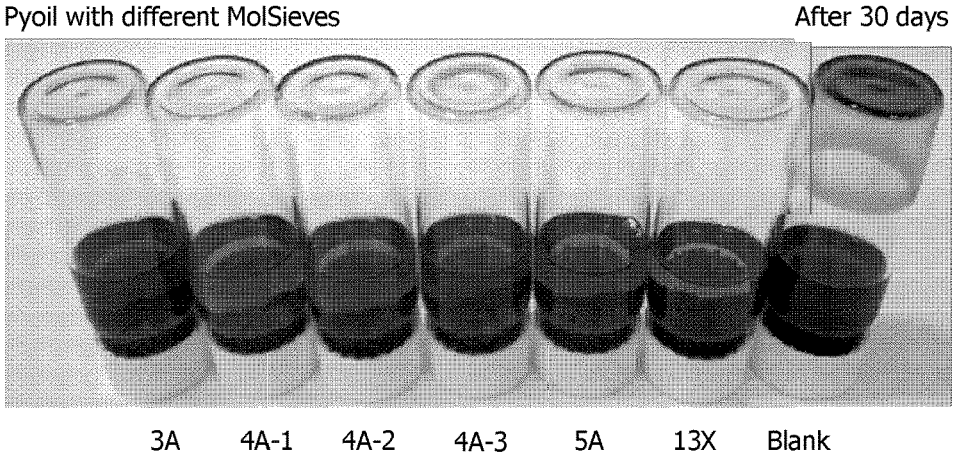

In FIGS. 3A-3D, compared to the blank (control) purging with air does not significantly reduced gum formation. The amount dependent efficacy of molecular sieve on pyoil gum formation was observed confirming the positive correlation between the amount of molecular sieve (from left to right 0.1 g, 0.5 g, 1 g, 1.5 g, 2 g, 0 g molecular sieve) and gum formation (FIGS. 3C and 3D).

Several commercially available molecular sieves with different composition ($K_{12}$ $[(AlO_2)_{12}(SiO_2)_{12}]\cdot nH_2O$; $Na_{12}$ $[(AlO_2)_{12}(SiO_2)_{12}]\cdot nH_2O$; $Ca_{4.5}[(AlO_2)_{12}(SiO_2)_{12}]\backslash\cdot nH2O$; $Na_{86}[(AlO_2)_{86}(SiO_2)_{106}]\cdot nH_2O$) and porosity (3-10 Angstroms) were tested against $N_2$ purged and blank pyoil samples as shown in FIGS. 4A-4D. 3A corresponds to $K_{12}$ $[(AlO_2)_{12}(SiO_2)_{12}]\cdot nH_2O$, 4A corresponds to $Na_{12}[(AlO_2)_{12}(SiO_2)_{12}]\cdot nH_2O$ with different porosity and forms (beads/pallets), 5A corresponds to $Ca_{4.5}[(AlO_2)_{12}(SiO_2)_{12}]\backslash\cdot nH_2O$, 13X corresponds to $Na_{86}[(AlO_2)_{86}(SiO_2)_{106}]\cdot nH_2O$.

Figure 5:
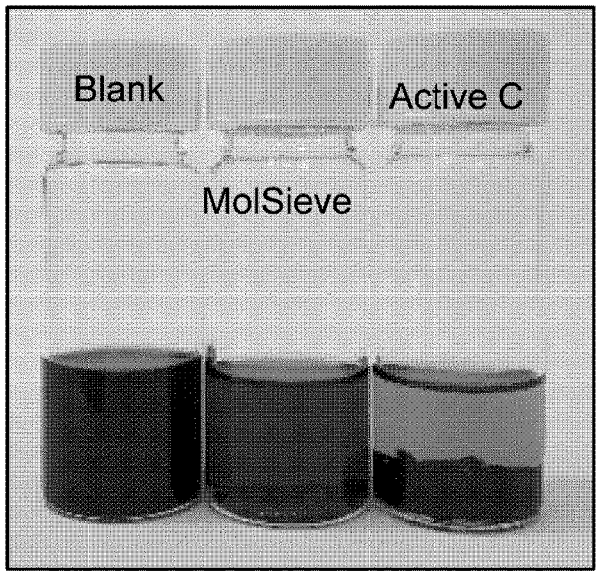
FIG. 5 shows comparisons of gum formation and color changes in molecular sieve (middle) and active charcoal (right) treated pyoil samples.

Results clearly indicate that most of the tested molecular sieves were effective in reducing gum formation. Similar to the molecular sieve, active charcoal also confirmed reduction of gum formation as shown in FIG. 5. Moreover, concentration dependency experiments suggest significantly higher efficacy of active charcoal in preventing the gum.

Example 2

Treating Pyoil with an Adsorbent

About 0.1 to 2 g of various adsorbent materials including molecular sieves and active charcoals etc., were added to the 10 mL of pyoil in 20 mL vials. The mixture was kept for a specific period. The samples were tested for changes in color, changes in total organic nitrogen and oxygen containing compounds. The color changes were checked by visual inspection and by grey scale and RGB % analysis. Density was measured by gravimetric measurement against specific volume. The chlorinated species were detected and quantified by a GC×GC-HRMS system. Total organic nitrogen contents were measured by an isocratic GC-NCD system. Measurement of oxygenates were assessed by a comprehensive GC×GC-HRMS system. Pyoil oxygenates were measured by direct injection of pyoil, whereas molecular sieve/active charcoal trapped components were measured by extracting those by tetrahydrofuran, followed by injecting to GC×GC.

Figure 6A:
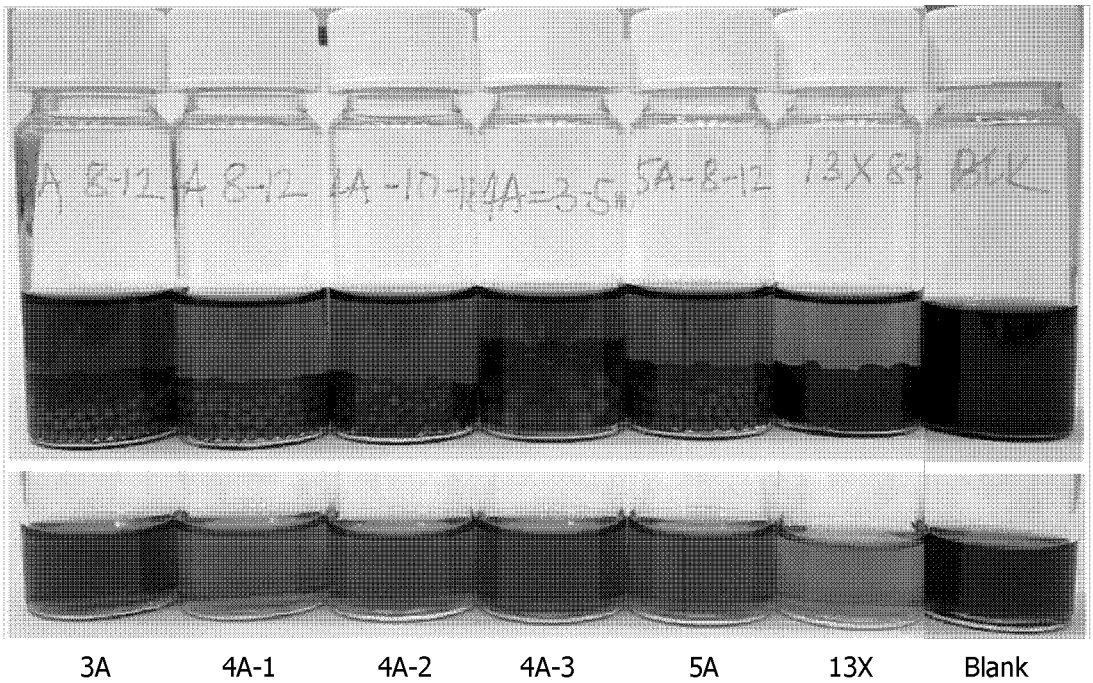
FIG. 6A shows photos of color of different molecular sieves treated pyoil.
Figure 6B:
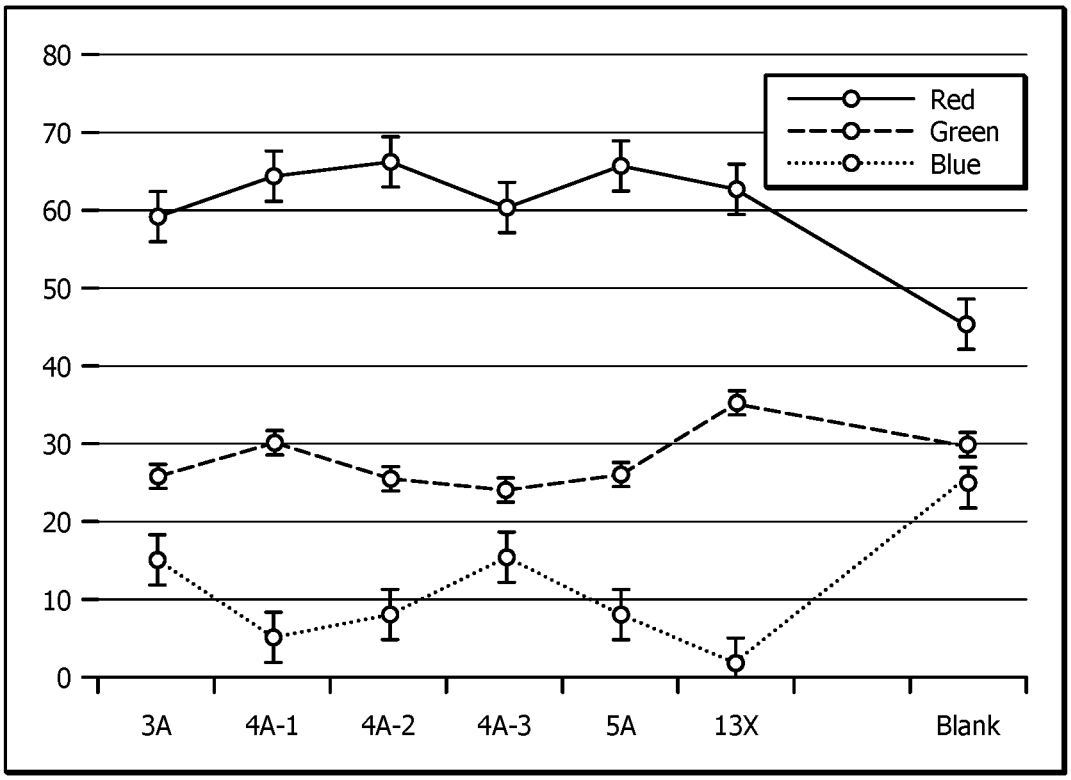
FIG. 6B shows changes in RGB % in the samples shown in FIG. 6A.
Figure 7A:
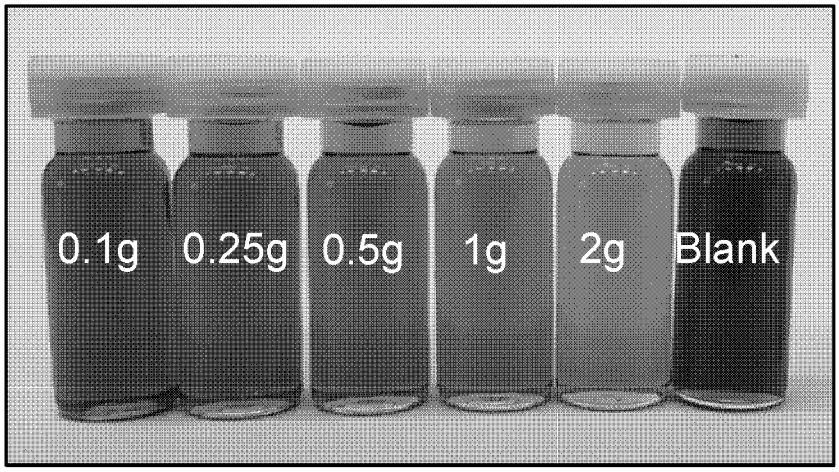
FIG. 7A shows changes in color of pyoil with the treatment of different amount of molecular sieves.
Figure 7B:
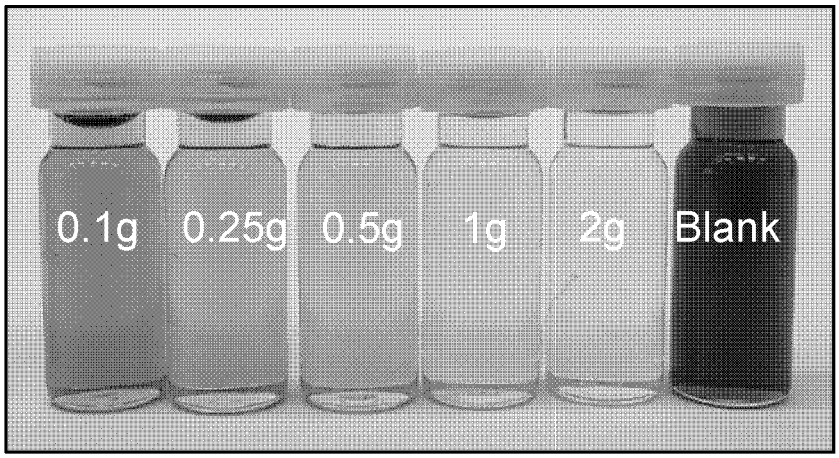
FIG. 7B shows changes in color of pyoil with the treatment of different amount of activated charcoal.

Experiments on different types of molecular sieves revealed different efficacy levels on reducing the darkness of the pyoil (FIGS. 6A-6B). RGB % based analysis (FIG. 6B) reveals that mainly the Red (positively) and Blue (negatively) color components were impacted by lightening the pyoil color. Further dosage dependent (0.1-2 g) studies revealed that both molecular sieve and active charcoal have a highly positive correlation in reducing the color of the pyoil as shown in FIGS. 7A (molecular sieve) and 7B (activated carbon (charcoal)).

Figure 8A:
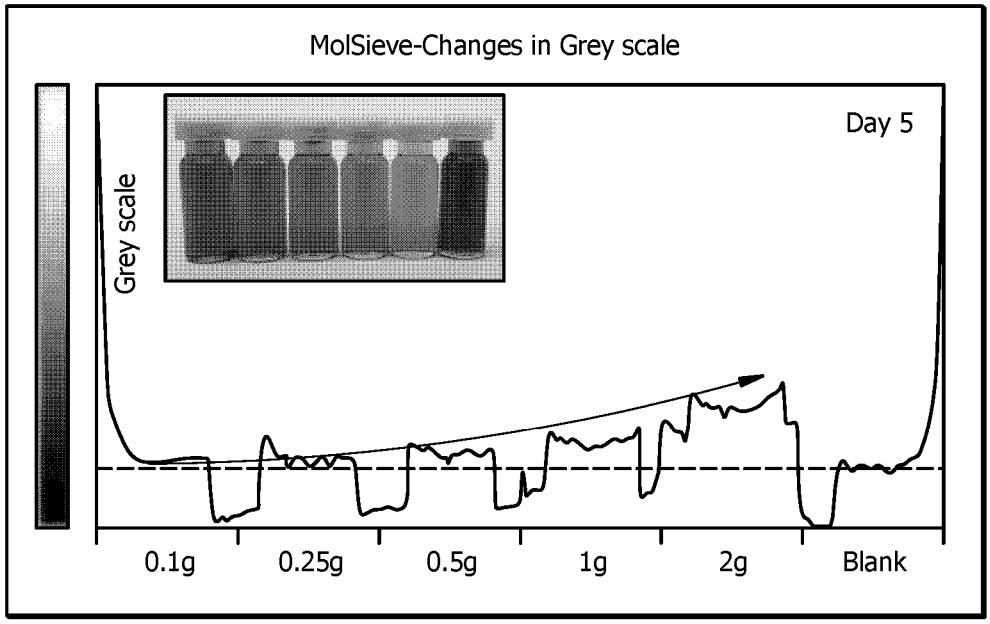
FIG. 8A shows grayscale analysis of changes in pyoil darkness for treatment with different amount of molecular sieves.
Figure 8B:
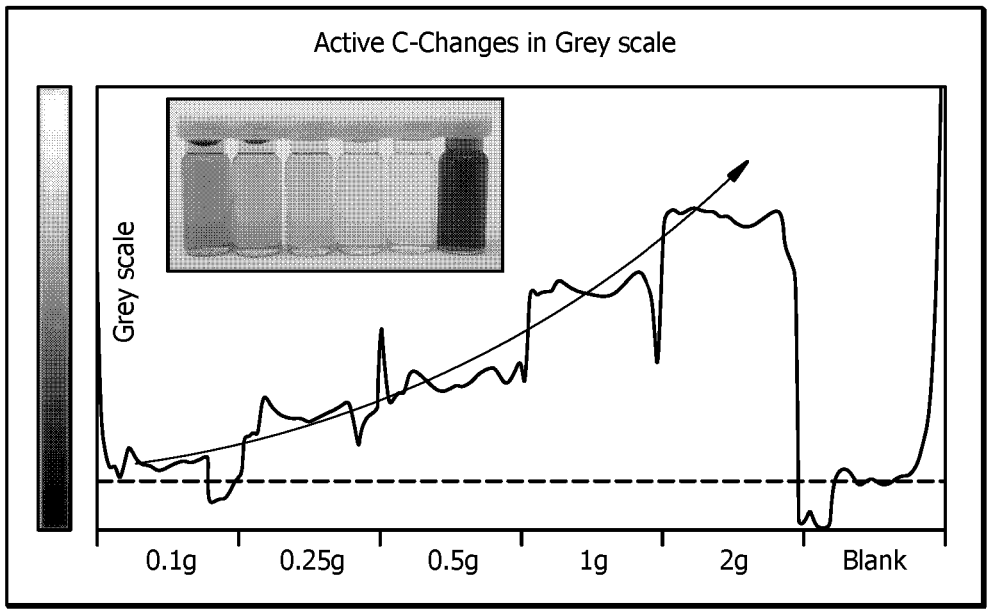
FIG. 8B shows grayscale analysis of changes in pyoil darkness for treatment with different amount of activated charcoal.
Figure 8C:
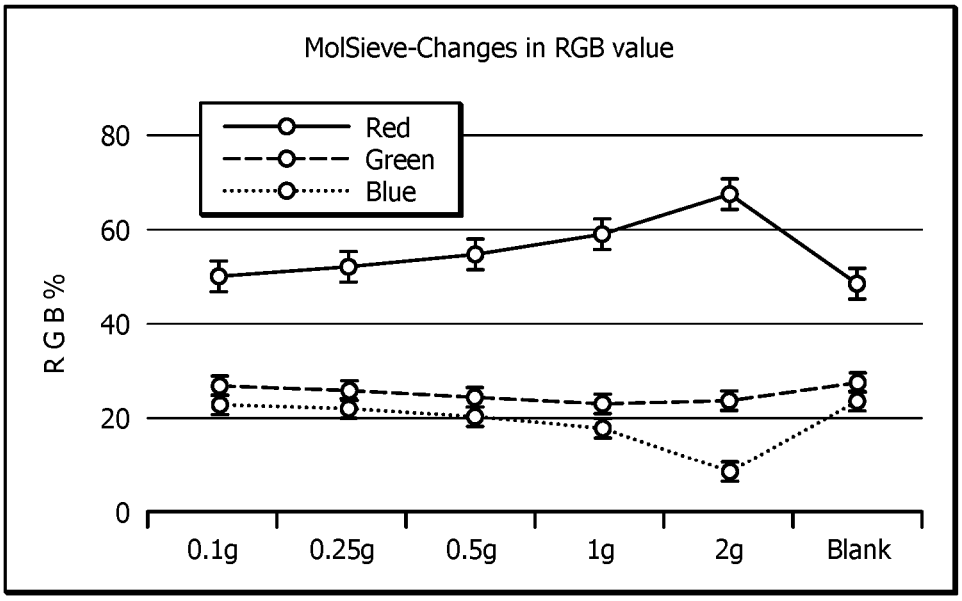
FIG. 8C shows RGB % results corresponding to samples of FIG. 8A.
Figure 8D:
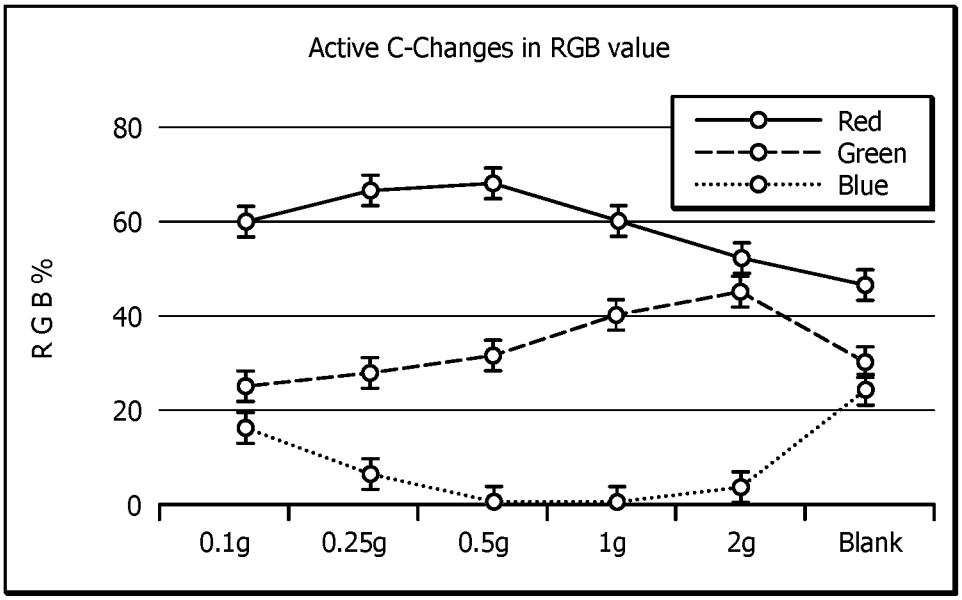
FIG. 8D shows RGB % results corresponding to samples of FIG. 8B.

Quantitative analysis of grey scale for amount dependent effect on the pyoil color further justifies the same (FIGS. 8A-8B). Comparably, active charcoal has better efficacy to reduce the dark color of pyoil. RGB % based results (FIGS. 8C-8D) for amount dependent reduction of darkness confirm that for the molecular sieve, the Red (positively) and Blue (negatively) color components were impacted by lightening the pyoil color. In contrast, for active charcoal, Green color components showed a positive relationship, whereas changes of Red and Blue components showed no clear correlation.

The results further imply that the microporous molecular sieves and mesoporous active charcoals absorb different classes of compounds with varied affinity.

Figure 9:
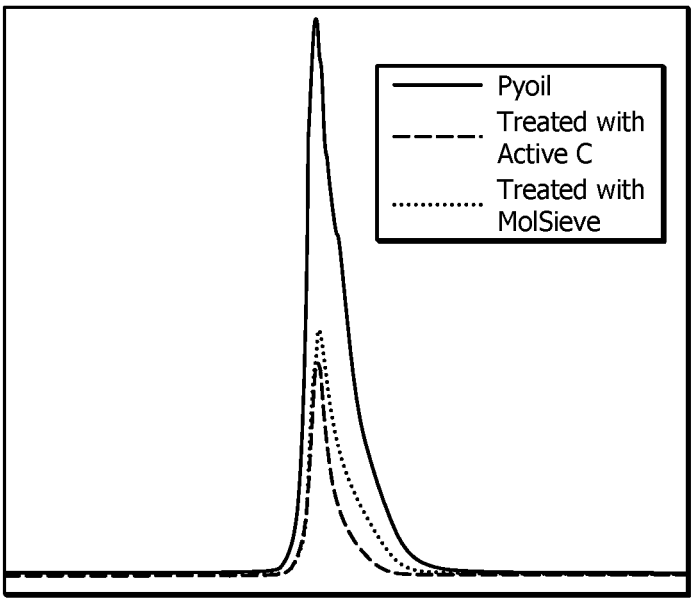
FIG. 9 shows changes in total organic nitrogen (TON) in pyoil treated with molecular sieves and activated charcoals.

Reduction of total organic nitrogen: As shown in FIG. 9, total organic nitrogen contents (TON) measured by an isocratic GC-NCD system confirmed significant reduction of TON in both molecular sieve and active charcoal treated pyoil compared to untreated blank pyoil. Active charcoal showed better reduction of TON compared to molecular sieves. It indicates a strong correlation between color bodies and nitrogen containing compounds, which are significantly trapped by the molecular sieve and active charcoal.

Figure 10:
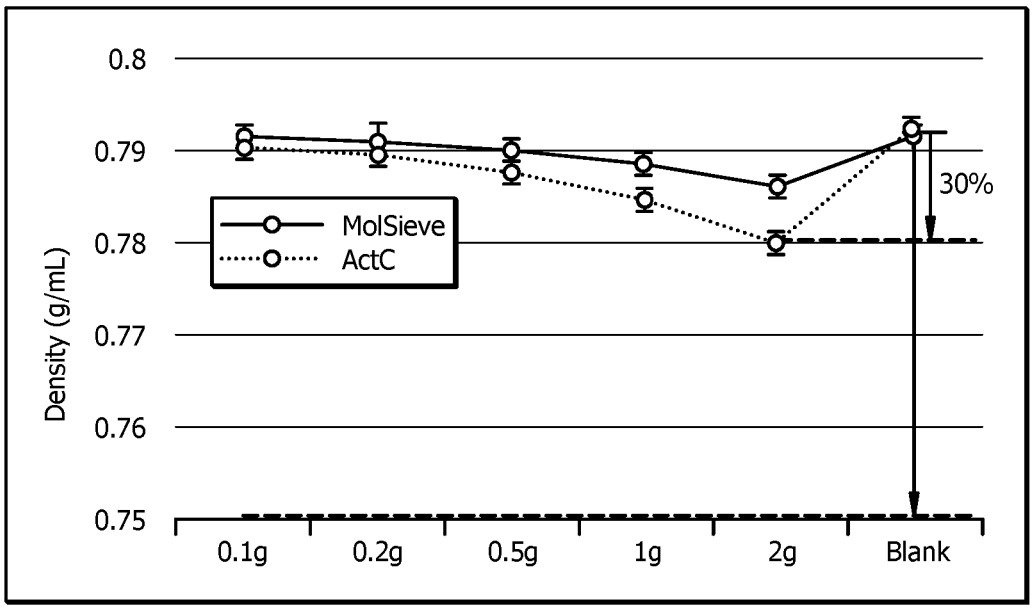
FIG. 10 shows changes in density in pyoil treated with molecular sieves and activated charcoal.

Reduction of density: As shown in FIG. 10, dosage dependent treatment of both the molecular sieve and active charcoal resulted in decreasing the density of the treated pyoil. The maximum amount applied yielded about 15 and 30% reduction in density by molecular sieve and active charcoal towards conventional condensates, respectively.

Figure 11:
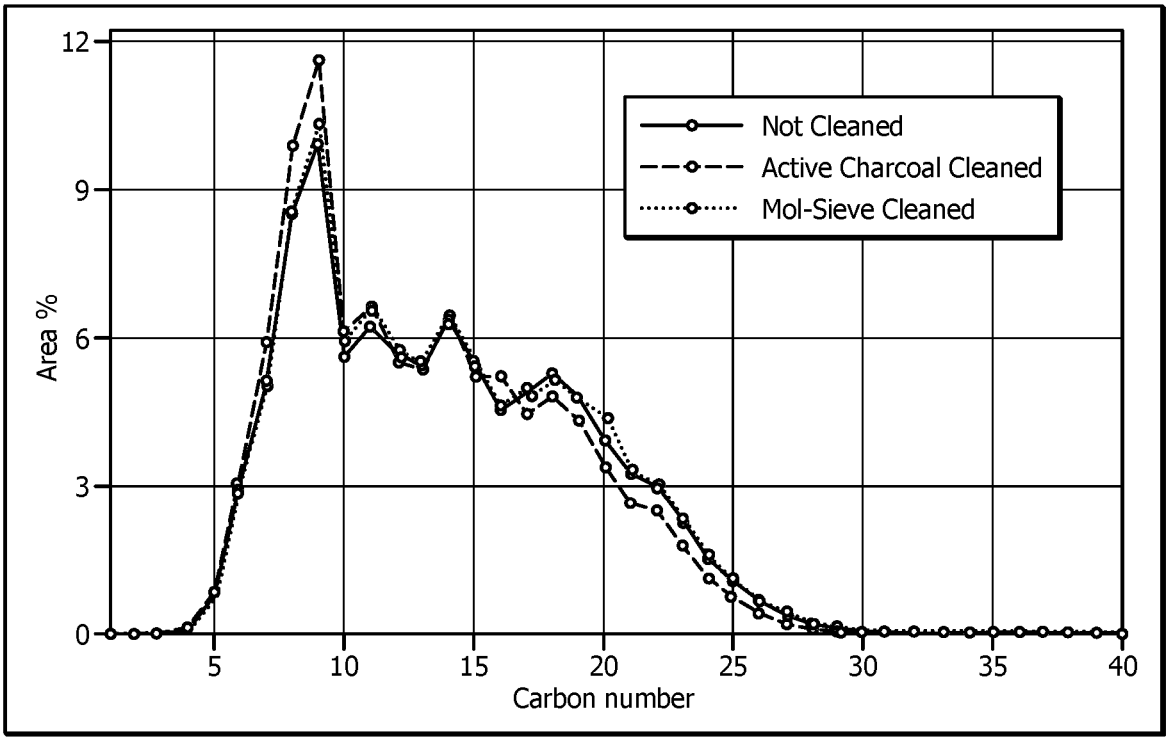
FIG. 11 shows changes in hydrocarbon composition (carbon number) for untreated and treated pyoil using molecular sieves and activated charcoal.

Detailed hydrocarbon group type analysis (PINA) reveals that both activated charcoal and molecular sieve reduced the heavier hydrocarbons, where the reduction was significantly higher in case of active charcoal treatment (FIG. 11). Reduction of those heavies contributed to reduce the density of the treated pyoil.

Figure 12:
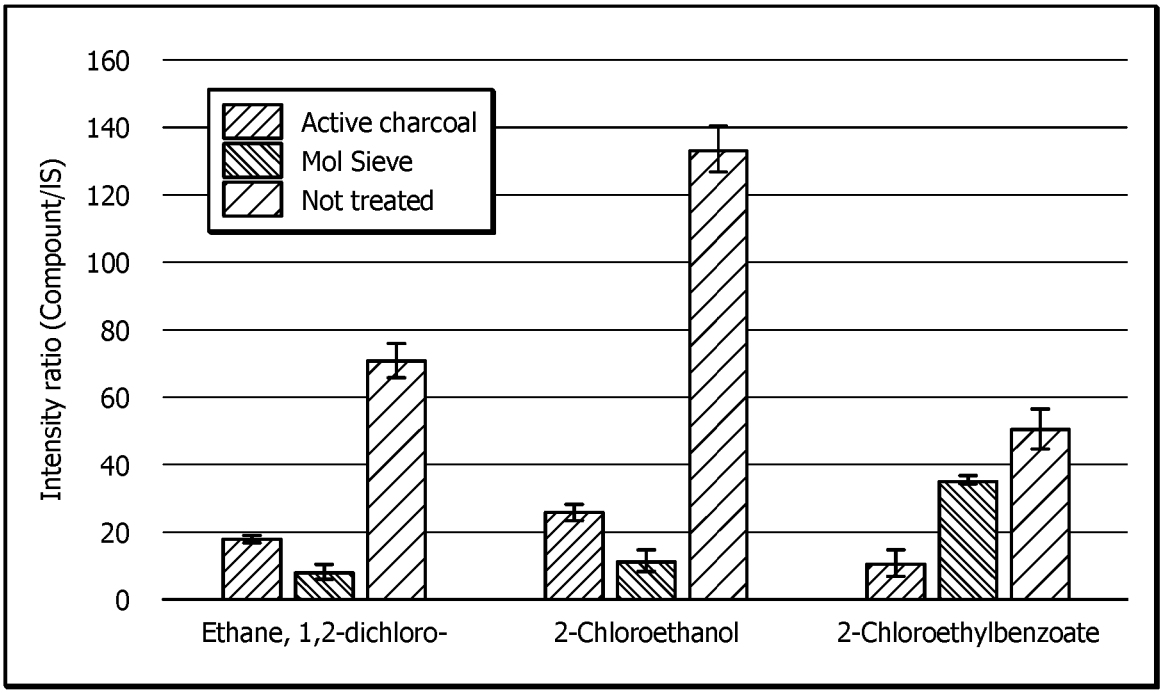
FIG. 12 shows changes in selected chlorinated species in pyoil treated with molecular sieves and active charcoals.

Reduction of chlorinates: Speciation of chlorinated compounds clearly revealed that treatment of both the molecular sieve and active charcoal resulted in decreasing chlorinated compounds. As shown in a few of the representative chlorinated species in FIG. 12, a significant decrease was observed by the molecular sieve and active charcoal treatments. It clearly indicated that these treatments have the potential to reduce total chlorinated compounds in pyoil.

Reduction of oxygenates: Comprehensive GC×GC-HRMS analysis reveals that compared to untreated pyoil, pyoil treated with the molecular sieve and active charcoal contain significantly lower amount of oxygenates than the control. In-depth analysis clearly indicated that carboxylic acids, phenols, ketones, aldehydes are the main contributors of oxygenates present in the pyoil which are significantly eliminated from the treated pyoil. Though active charcoal removed significant amount of oxygenates, a portion of carboxylic acids were remained in treated pyoil. In contrast, active charcoal treated pyoil revealed a significant reduction of di-/poly-aromatic compounds compared to molecular sieves.

Further in depth analysis of heteroatoms clearly indicated a significant decrease for majority of the unwanted heteroatoms up to 30 fold (active charcoal) or 140 fold (molecular sieve) decrease, even decreased down to a not detectable limit (See Tables 1, 2, and 3).

TABLE 1

Table 1. Analysis of heteronates before and after cleaning by Active charcoal and Mol sieves.

| | | | | Compound/IS ratio* Indicating abundance | Fold-decrease in contents after cleaning | |
|---|---|---|---|---|---|---|
| SABIC ID | Compounds | Molecular formula | MW (Da) | of the compounds in not cleaned sample Not Cleaned | Active Charcoal Cleaned | Mol Sieve Cleaned |
| 343 | 2-Heptadecanone | C17H34O | 254 | 4.89 | 1.6 | 0.8 |
| 14 | 2-pentanone | C5H10O | 86 | 3.78 | 1.0 | 1.0 |
| 338 | Caprolactam | C6H11NO | 113 | 3.56 | 2.7 | 7.6 |
| 822 | 3-heptanol, methyl (iso2) | C8H18O | 130 | 2.81 | 16.1 | Not detected (ND) |
| 377 | Octadecanenitrile | C18H35N | 265 | 2.55 | 3.1 | 1.0 |
| 1009 | Oleanitrile | C18H35N | 263 | 2.09 | 3.2 | 1.0 |
| 78 | Cyclopentanone | C5H8O | 84 | 1.85 | Not detected (ND) | 1.3 |
| 291 | Tridecanenitrile | C13H25N | 195 | 1.78 | 17.6 | 1.4 |
| 271 | Heptanoic acid | C7H14O2 | 130 | 1.76 | 1.8 | 108.7 |
| 1006 | Dodecanophenone | C18H28O | 260 | 1.53 | 7.4 | 1.0 |

TABLE 2

Table 2. Top 10 compounds removed by Active charcoal.

| SABIC ID | Compounds | Molecular Formula | MW (Da) | Compound/IS ratio* Indicating abundance of the compounds in not cleaned sample Not Cleaned | Fold-decerease in contents after cleaning: Active Charcoal Cleaned | Fold-decerease in contents after cleaning: Mol Sieve Cleaned |
|---|---|---|---|---|---|---|
| 605 | 2-Cyclopentenol | C5H8O | 84 | 1.19 | 32.4 | Not Detected (ND) |
| 62 | 1-butanol | C4H10O | 74 | 0.59 | 31.8 | 2.6 |
| 371 | Benzoic acid | C7H6O2 | 122 | 1.34 | 30.8 | 39.5 |
| 453 | Hexanenitrile | C6H11N | 97 | 0.65 | 26.9 | 1.3 |
| 291 | Tridecanenitrile | C13H25N | 195 | 1.78 | 17.6 | 1.4 |
| 249 | 2-cyclopenten-1-one, 2-hydroxy-3-methyl | C6H8O2 | 112 | 0.19 | 17.3 | 29.5 |
| 822 | 3-heptanol, methyl (iso2) | C8H18O | 130 | 2.81 | 16.1 | Not Detected (ND) |
| 860 | Dodecanenitrile | C12H23N | 181 | 0.42 | 15.1 | 1.3 |
| 309 | Phenol, C5 substituted (iso2) | C10H14O | 150 | 0.22 | 12.8 | 2.3 |
| 258 | 2-Cyclopenten-1-one, 3-ethyl-2-hydroxy | C7H10O2 | 126 | 0.09 | 11.6 | 16.4 |

TABLE 3

Table 3. Top 10 compounds removed by Mol sieve.

| ID | Compounds | Molecular formula | MW (Da) | Compound/IS ratio* Indicating abundance of the compounds in not cleaned sample Not Cleaned | Fold-decerease in contents after cleaning: Active Charcoal Cleaned | Fold-decerease in contents after cleaning: Mol Sieve Cleaned |
|---|---|---|---|---|---|---|
| 243 | pentanoic acid, 4-methyl | C6H12O2 | 116 | 0.99 | 2.5 | 146.5 |
| 271 | Heptanoic acid | C7H14O2 | 130 | 1.76 | 1.8 | 108.7 |
| 371 | Benzoic acid | C7H6O2 | 122 | 1.34 | 30.8 | 39.5 |
| 249 | 2-cyclopenten-1-one, 2-hydroxy-3-methyl- | C6H8O2 | 112 | 0.19 | 17.3 | 29.5 |
| 301 | Octanoic Acid | C8H16O2 | 144 | 0.94 | 3.4 | 21.4 |
| 220 | Pentanoic acid | C5H10O2 | 102 | 0.49 | 2.8 | 19.3 |
| 823 | 3-heptanol, methyl (iso3) | C8H18O | 130 | 1.22 | 5.7 | 17.9 |
| 258 | 2-Cyclopenten-1-one, 3-ethyl-2-hydroxy- | C7H10O2 | 126 | 0.09 | 11.6 | 16.4 |
| 192 | Butanoic acid | C4H8O2 | 88 | 0.46 | 2.9 | 12.8 |
| 338 | Caprolactam | C6H11NO | 113 | 3.56 | 2.7 | 7.6 |

Further analysis of treated molecular sieves and active charcoal by extracting the trapped and/or adsorbed components by tetrahydrofuran reveals that molecular sieves mainly trapped oxygenates with residual long chains paraffinic hydrocarbons, while active charcoal trapped and/or adsorbed both oxygenates and di-/poly-aromatic compounds along with residual paraffinic hydrocarbons. This result corroborates the findings on varied RGB % for molecular sieve and active charcoal shown in FIGS. 8C and 8D.

Although embodiments of the present application and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the above disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. A method of processing pyrolysis oil (pyoil), the method comprising the following steps:

treating the pyoil with an adsorbent and thereby removing gum and/or gum precursors from the pyoil to produce a purified pyoil; and cracking the purified pyoil under reaction conditions sufficient to produce olefins and aromatics, wherein the adsorbent comprises:

an activated charcoal (carbon); and a molecular sieve comprising $K_{12}[(AlO_2)_{12}(SiO_2)_{12}]\cdot nH_2O$, $Na_{12}[(AlO_2)_{12}(SiO_2)_{12}]\cdot nH_2O$, $Ca_{4.5}[(AlO_2)_{12}(SiO_2)_{12}]\cdot nH_2O$, $Na_{86}[(AlO_2)_{86}(SiO_2)_{106}]\cdot nH_2O$, or combinations thereof.

2. The method of claim 1, wherein the treating step is further configured to increase stability of the pyoil.

3. The method of claim 1, wherein the treating step comprises flowing the pyoil through an adsorbent under processing conditions sufficient to remove at least some of, one or more of: (a) oxygen containing compounds, (b) nitrogen containing compounds, (c) chlorine containing compounds, (d) polynuclear aromatics and heavy tails ($C_{20}$+), (e) silicon containing compounds, and (f) heavy metals from the pyoil.

4. The method of claim 3, wherein the adsorbent is comprised in a guard bed, a purification column, a stirring tank, a fluidized bed, or a combination thereof.

5. The method of claim 3, wherein the molecular sieve has a pore size of 3 to 10 Å, and wherein the adsorbent further comprises a bleaching clay, a silica hydrogel, a cured eggshell powder, or combinations thereof.

6. The method of claim 3, wherein the oxygen and/or nitrogen containing compounds include aliphatic acids, aromatic acids, nitriles, amines, aldehydes, aliphatic/cyclic ketones, cyclic amides, aliphatic/aromatic alcohols, diols, esters, ethers, aliphatic/cyclic chlorines, furans, indoles, quinolines, phenolic compound, indolic compounds, acidic compounds, alcohols, amines, or combinations thereof.

7. The method of claim 6, wherein the oxygen and/or nitrogen containing compounds include 2-heptadecanone, 2-pentanone, caprolactam, 3-heptanol, methyl (iso2), octadecanenitrile, oleanitrile, cyclopentanone, traidecanenitrile, heptanoic acid, doedecanophenone, 2-cyclopentenol, 1-butanol, benzoic acid, hexanenitrile, tridecanenitrile, 2-cyclopenten-1-one, 2-hydroxy-3-methyl-, phenol, $C_5$ substituted (iso2), 2-cyclopenten-1-one, 3-ethyl-2-hydroxy-, or combinations thereof.

8. The method of claim 1, wherein the molecular sieve is configured to lighten the color of the pyoil, reduce total organic nitrogen, reduce density of the pyoil, reduce chlorinates concentration in the pyoil, reduce oxygenates of the pyoil, minimize the corrosion and/or fouling on downstream equipment, or combinations thereof.

9. The method of claim 8, wherein the adsorbent has a surface area in a range of 10 to 8000 $m^2/g$.

10. The method of claim 1, wherein the molecular sieve has a pore size of 3 to 10 Å.

11. The method of claim 1, wherein the treating step is conducted at a processing temperature of 10 to 100° C.

12. The method of claim 1, wherein the treating step is conducted at a processing pressure of 0.1 to 10 bar.

13. The method of claim 1, wherein the adsorbent does not or substantially does not decrease the production of the olefins and aromatics as compared to a similar method with the same steps except for the step of treating the pyoil with an adsorbent.

14. The method of claim 1, wherein the cracking includes steam-cracking.

15. The method of claim 14, wherein the steam cracking is conducted at a cracking temperature of 750 to 900° C.

16. The method of claim 14, wherein the steam cracking is conducted at a residence time of 1 to 4000 ms.

17. The method of claim 1, further comprising regenerating the adsorbent via thermal regeneration, thermal and vacuum regeneration, rinsing with strong acid or strong basic solutions, solvent rinsing of the adsorbent, or combinations thereof.

18. The method of claim 1, further comprising removing the adsorbent from the purified pyoil via settling, filtration, cyclone, or combinations thereof.

19. A method of processing pyoil, the method comprising:

treating the pyoil with one or more non-silica based adsorbents and thereby removing gum and/or gum precursors from the pyoil to produce a purified pyoil; and utilizing the purified pyoil as a liquid fuel, wherein the non-silica based adsorbents comprise:

an activated charcoal (carbon); and a molecular sieve comprising $K_{12}[(AlO_2)_{12}(SiO_2)_{12}]\cdot nH_2O$, $Na_{12}[(AlO_2)_{12}(SiO_2)_{12}]\cdot nH_2O$, $Ca_{4.5}[(AlO_2)_{12}(SiO_2)_{12}]\cdot nH_2O$, $Na_{86}[(AlO_2)_{86}(SiO_2)_{106}]\cdot nH_2O$, or combinations thereof.

* * * * *